US006878192B2

(12) United States Patent
Pasic

(10) Patent No.: US 6,878,192 B2
(45) Date of Patent: Apr. 12, 2005

(54) ELECTROSTATIC SIEVING PRECIPITATOR

(75) Inventor: Hajrudin Pasic, Athens, OH (US)

(73) Assignee: Ohio University, Athens, OH (US)

( * ) Notice: Subject to any disclaimer, the term of this patent is extended or adjusted under 35 U.S.C. 154(b) by 0 days.

(21) Appl. No.: 10/730,595

(22) Filed: Dec. 8, 2003

(65) Prior Publication Data

US 2004/0149132 A1 Aug. 5, 2004

Related U.S. Application Data

(60) Provisional application No. 60/478,872, filed on Jun. 16, 2003, and provisional application No. 60/431,941, filed on Dec. 9, 2002.

(51) Int. Cl.[7] ..... B03C 3/47

(52) U.S. Cl. ..... 96/66; 96/77; 96/96; 96/98

(58) Field of Search ..... 96/64–66, 77–79, 96/95, 96, 98

(56) References Cited

U.S. PATENT DOCUMENTS

| | | | | | |
|---|---|---|---|---|---|
| 1,381,660 | A | | 6/1921 | Rathbun | 95/57 |
| 1,479,271 | A | | 1/1924 | Walcott | 95/70 |
| 3,392,509 | A | * | 7/1968 | Pelosi, Jr. | 96/66 |
| 3,616,606 | A | | 11/1971 | Vincent | 96/66 |
| 3,668,836 | A | | 6/1972 | Richardson et al. | 96/66 |
| 3,820,306 | A | * | 6/1974 | Vincent | 96/54 |
| 4,038,049 | A | * | 7/1977 | Melcher et al. | 95/62 |
| 4,354,858 | A | * | 10/1982 | Kumar et al. | 95/78 |
| 5,009,683 | A | * | 4/1991 | Sun | 96/66 |
| 5,158,580 | A | | 10/1992 | Chang | 95/70 |
| 5,474,599 | A | * | 12/1995 | Cheney et al. | 96/55 |
| 5,476,538 | A | * | 12/1995 | Nishio et al. | 95/70 |
| 5,593,476 | A | | 1/1997 | Coppom | 95/78 |
| 5,695,549 | A | | 12/1997 | Feldman et al. | 96/55 |
| 5,755,333 | A | | 5/1998 | Stencel et al. | 209/127.1 |
| 5,855,653 | A | * | 1/1999 | Yamamoto | 96/58 |
| 5,938,041 | A | | 8/1999 | Stencel et al. | 209/127.4 |
| 5,961,693 | A | * | 10/1999 | Altman et al. | 95/78 |
| 6,152,988 | A | | 11/2000 | Plaks et al. | 95/58 |
| 6,162,285 | A | * | 12/2000 | Fong et al. | 96/66 |
| 6,231,643 | B1 | * | 5/2001 | Pasic et al. | 95/75 |
| 6,375,714 | B1 | * | 4/2002 | Rump et al. | 95/3 |
| 6,398,848 | B1 | * | 6/2002 | Ridgeway et al. | 95/69 |
| 6,585,803 | B1 | | 7/2003 | Chang et al. | 95/70 |

FOREIGN PATENT DOCUMENTS

| | | | | |
|---|---|---|---|---|
| GB | 2016305 | * | 9/1979 | 96/96 |
| JP | 53-112578 | * | 10/1978 | 96/77 |

* cited by examiner

*Primary Examiner*—Richard L. Chiesa
(74) *Attorney, Agent, or Firm*—Jason H. Foster; Kremblas, Foster, Phillips & Pollick

(57) ABSTRACT

An electrostatic precipitator using substantially planar screens of similar charge positioned perpendicular to the gas flow direction. The screens have a similar charge of the same polarity, and particles flowing through the screens are charged, agglomerated and either collected on the screens or fall downwardly into collecting hoppers below the screens. The screens preferably have openings smaller than 3 millimeters and are spaced apart less than 10 millimeters. In an alternative embodiment, the screens have alternating polarities and are spaced about an inch or more apart to prevent sparkover.

24 Claims, 6 Drawing Sheets

| Table 1 | | | | | | | | | |
|---|---|---|---|---|---|---|---|---|---|
| Sample from: | FA | 1FE | 1BE | 1FC | 1BC | 5FE | 5BE | 5FC | 5BC |
| C % | 2.23 | 15.0 | 1.46 | 9.69 | 4.92 | 1.22 | 1.3 | 1.64 | 1.89 |

| Table 2 | | | | | |
|---|---|---|---|---|---|
| Sample from: | FA | 1F | 1B | 5F | 5B |
| Nitrogen % | 0.03 | 0.03 | 0.17 | 0.02 | 0.02 |

| Table 3 | | | | | |
|---|---|---|---|---|---|
| Sample from: | FA | 1F | 1B | 5F | 5B |
| Sulfur % | 0.9 | 4 | 1.04 | 0.93 | 0.9 |

ELECTROSTATIC SIEVING PRECIPITATOR

(b) CROSS-REFERENCE TO RELATED APPLICATIONS

This application claims the benefit of U.S. Provisional Application No. 60/431,941 filed Dec. 9, 2002 and U.S. Provisional Application No. 60/478,872 filed Jun. 16, 2003.

(c) STATEMENT REGARDING FEDERALLY-SPONSORED RESEARCH AND DEVELOPMENT (Not Applicable)

(d) REFERENCE TO AN APPENDIX (Not Applicable)

(e) BACKGROUND OF THE INVENTION

1. Field of the Invention

The invention relates generally to a gas cleaning process and apparatus, and more particularly relates to a process and apparatus that utilize electrostatically charged fine screens for promoting agglomeration of small particles in a gas stream into larger clusters and removing particles entrained in the gas stream.

2. Description of the Related Art

Industrial electrostatic precipitators (ESPs) are used in coal-fired power plants, the cement industry, mineral ore processing and many other industries to remove particulate matter from a gas stream. ESPs are particularly well suited for high efficiency removal of very fine particles from a gas stream. Specially designed ESP's have attained particle collection efficiencies as high as 99%.

Conventional ESPs typically remove 90–99% of the fly-ash and dust in the flue gas. Fuel switching and sulfur control systems upstream of the ESPs modify flyash properties and reduce precipitator collection efficiency. In addition, conventional ESPs are inefficient in capturing sub-micron sized particles. Toxic trace metals and their compounds, as well as heavy organics, tend to concentrate on fine particulates in the range of 0.1–2.0 microns. Faced with increasingly stringent environmental requirements, utilities that produce such gases are looking for alternative solutions, low cost retrofits or complete replacement of their precipitators in order to capture all of these materials.

One way to overcome these problems is to replace the existing under-performing ESPs with "baghouse" filters. Although such filters operate with very high collection efficiencies (greater than 99.9%), independent of flyash properties, they possess very low filtration velocities, they are large and, therefore, require significant space, they are costly to build, and are therefore unattractive for retrofitting of existing precipitators. Reducing the size of such filters by increasing filtration velocity results in substantial pressure drops, which are known to be disadvantageous. There is a potential for blinding of the bags, and even fire. Because of the small bag spacing, much of the dust removed from one row of bags is re-collected on the adjacent rows of bags.

Most recently, efforts have been made to install baghouse filters as the polishing units installed after conventional ESPs, such as in "Compact Hybrid Particulate Collector" (known as COHPAC) disclosed in U.S. Pat. No. 5,158,580. Additionally, it is known that electrical enhancement of filtration results in a reduction of pressure drop. Hence some baghouses have electrostatically enhanced fabric filtration section, such as in U.S. Pat. No. 6,152,988.

It is also possible to use perforated structures and grids set in the direction perpendicular to that of gas flow. The prior art includes U.S. Pat. Nos. 1,381,660; 1,479,271; 3,616,606; 3,668,836; 5,593,476; 5,695,549 and 6,585,803. In U.S. Pat. Nos. 1,381,660 and 1,479,271, grounded screen collection electrodes are preceded by vertical, spaced-apart wire discharge electrodes. However, because of large apertures or spacing, none of these discharge electrodes can produce substantially uniform corona discharge to charge the particles passing through, although this charging is a prerequisite for a successful capture of particles, especially very fine ones.

U.S. Pat. No. 3,616,606 discloses a two-stage precipitator. The first stage is similar to that in conventional precipitators and is used to pre-charge the particles and only partially collect them. The second stage consists of a plurality of electrically charged corona-free perforated structures with "one or more apertures" of unspecified size, set perpendicular to the gas flow and used to "slow down" the particulate matter and to collect earlier charged particulate by charging the perforated electrodes with different charged formations. However, such electrodes are not meant and cannot be used for corona production.

U.S. Pat. No. 3,668,836 discloses the use of vertical, electrically charged, ionizing rods/wires that are spaced out upstream of a plurality of grounded, perforated collection electrode plates with 0.5-inch or larger holes set perpendicular to the gas flow direction.

U.S. Pat. No. 5,695,549 discloses a so-called "agglomerator" that is installed before a conventional precipitator in order to agglomerate small particles for easier capture by the precipitator. The particulate matter passes at very high speeds (50 ft/s) through a series of parallel and oppositely charged pairs of discharge and collection screen electrodes with openings as large as 0.25 to 1.0 inch. The discharge electrodes have pointed, protruding elements for forming a substantially uniform corona discharge. Unlike previously mentioned disclosures in which the grid spacing and/or aperture size is selected to maximize the collection of charged particles, the agglomerates in this system are intended to re-entrain into the gas stream to be subsequently removed by conventional precipitator. It is to be expected that collection plates or grids with such large openings in both U.S. Pat. No. 3,668,836 and U.S. Pat. No. 5,695,549 would have problems in efficiently collecting and/or agglomerating fine particles.

U.S. Pat. No. 5,593,476 discloses an apparatus that utilizes a combination of large-opening grids, and a fibrous filter that is polarized by a high potential difference between electrodes. U.S. Pat. No. 6,585,803 discloses utilization of a sintered, stainless steel fibrous filter in a so-called point-to-plane electrostatic precipitator operating at low filter face velocities.

There is a need for a high efficiency collection device that is easily retrofitted into existing space, causes agglomeration of particles into larger clusters and efficiently removes all large and very fine particles from the gas stream.

(f) BRIEF SUMMARY OF THE INVENTION

The invention is an electrostatic particulate collection apparatus mounted in a fluid stream containing particulate matter. The apparatus comprises a first substantially planar corona-producing screen mounted in the fluid stream transverse to a fluid stream flow direction. The first screen has an electrical charge sufficient to create a corona, and a plurality of openings smaller than about three millimeters. In a preferred embodiment, the openings are about one millimeter. A second substantially planar screen is mounted in the fluid stream transverse to the fluid stream flow direction. The second screen is spaced from the first screen less than about 10 millimeters. The second screen has a plurality of openings smaller than about three millimeters and an electrical charge sufficient to create a corona and of the same polarity as the first screen's electrical charge. In a preferred embodiment, the openings are about one millimeter. A collector is mounted below the screens for receiving particulate.

A particularly preferred embodiment of the invention includes an array of substantially planar screens mounted in the fluid stream transverse to the fluid stream flow direction, and spaced less than about 10 millimeters from the second screen. Each of the screens in the array has a plurality of openings smaller than about three millimeters, preferably about one millimeter, and an electrical charge sufficient to create a corona and of the same polarity as the first screen's electrical charge.

A slightly modified version of the preferred embodiment is also suitable for sorting and classification of collected particles in general, and in flyash beneficiation in power plants, in particular. This version has screens with different polarities, and a plurality of collectors.

Thus, the invention relates to a screen-based electrostatic precipitator suitable for efficient concurrent removal of both large and fine particulate from a gas stream. In this apparatus the particulate laden gas passes through a plurality of closely packed parallel wire meshes, which are preferably fine planar screens, disposed perpendicular to the direction of gas flow and connected to a high voltage source. In one of the preferred embodiments, these screens have the same polarity. As a result, all particles in the gas that flow through the screens are substantially uniformly and well charged and have the same polarity.

This uniform charging promotes agglomeration of fine particles as the particles pass through the screen openings. The particles combine to form large particles, which makes capture easier. Because the screens have the same polarity, they can be closely packed and a high voltage can be applied virtually without limits and without sparkover. All this results in a drastic reduction of the precipitator size, better particulate charging, reduced clogging, and increased particle collection efficiency. The invention is suited for cleaning gases emitted from various industrial installations such as power plants, incinerators and alike. Moreover, it is suitable for promoting agglomeration of any particulate matter in numerous other industries and applications.

The precipitator, if modified, can operate at very high temperatures, up to 1500 degrees F., as well as in wet conditions. The important feature in all the embodiments is that the particles are charged by plain screens with small openings. This increases the probability for better charging, enhances uniform charging of particles and reduces the distance between the electrodes. The invention has the benefits of conventional sieving and electrostatic precipitation, with dust collection mechanisms comprising electrostatic (field) charging, diffusion (turbulent deposition), inertial impaction and interception, all combined in laminar flow conditions.

(g) BRIEF DESCRIPTION OF THE SEVERAL VIEWS OF THE DRAWINGS

FIG. 1 is a schematic illustrating the preferred embodiment of the present invention.

FIGS. 2(*a*) and 2(*b*) illustrate a screen opening with coagulation mechanism occurring in the precipitator of FIG. 1.

FIG. 3 is a schematic illustrating an alternative embodiment of the present invention suitable for particulate separation and its beneficiation.

FIGS. 4(*a*) and 4(*b*) illustrate a screen opening with coagulation mechanism occurring in the alternative embodiment of FIG. 3.

Figure 7:
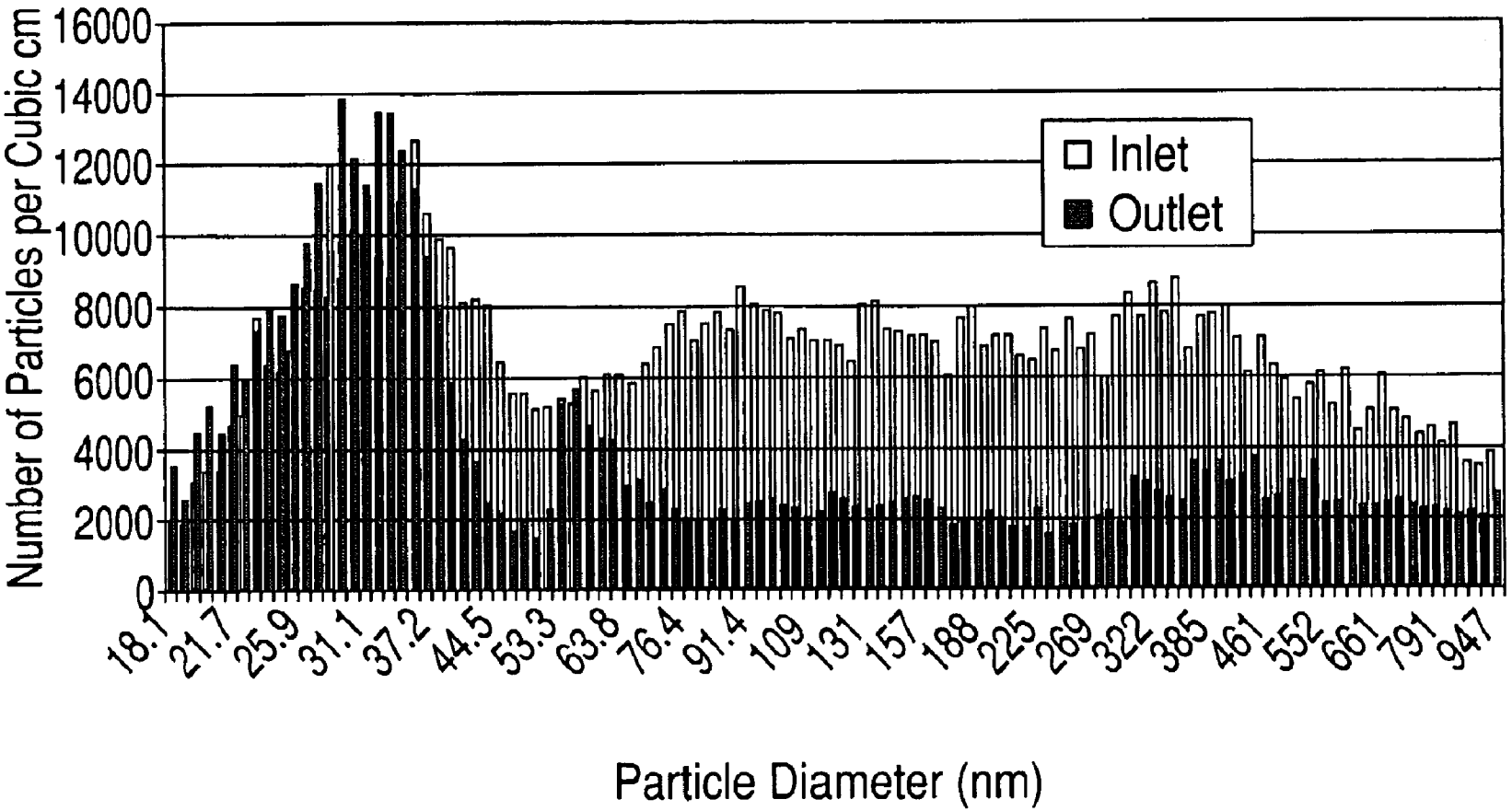
Figure 8:
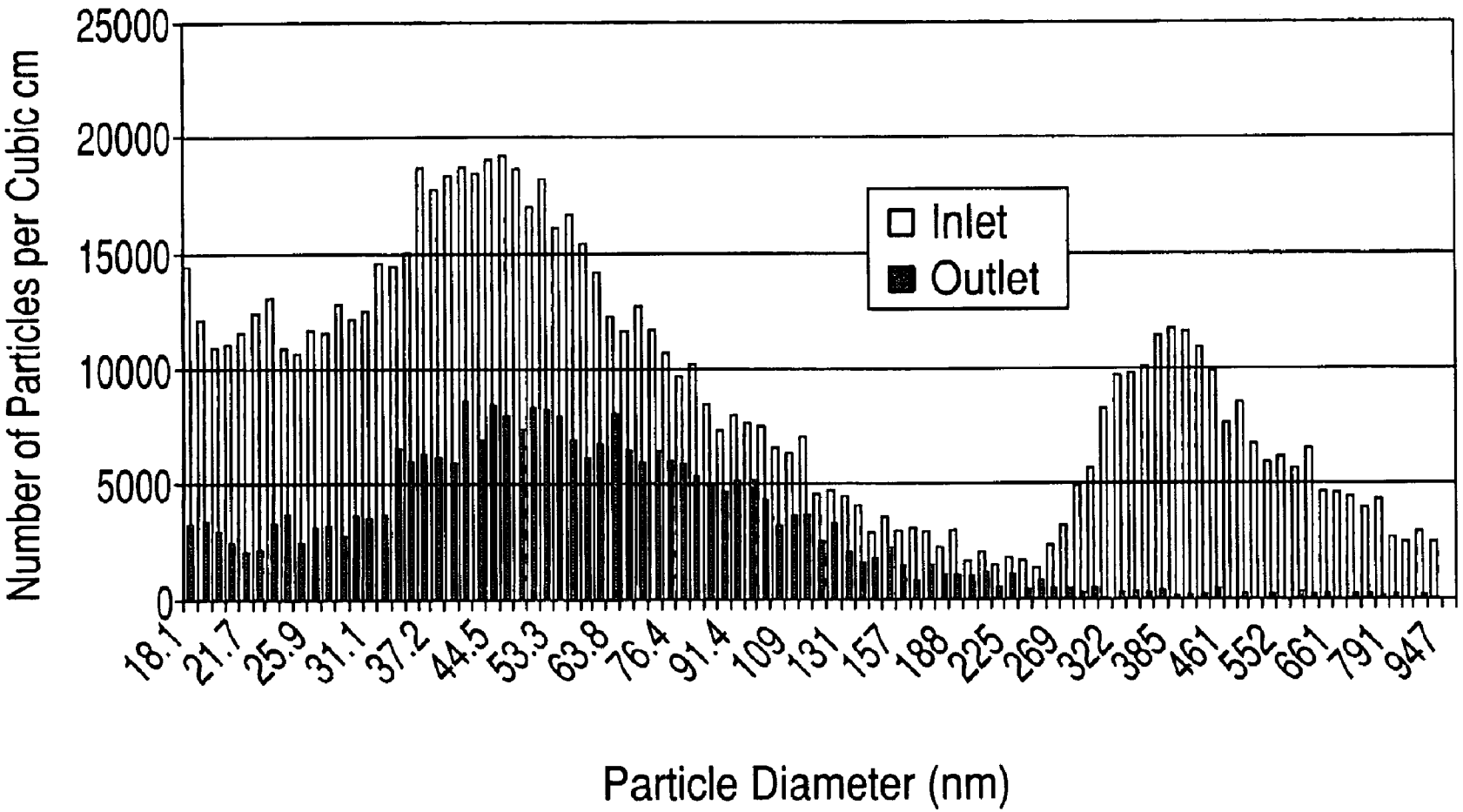
Figures 9, 10, 11, 12:
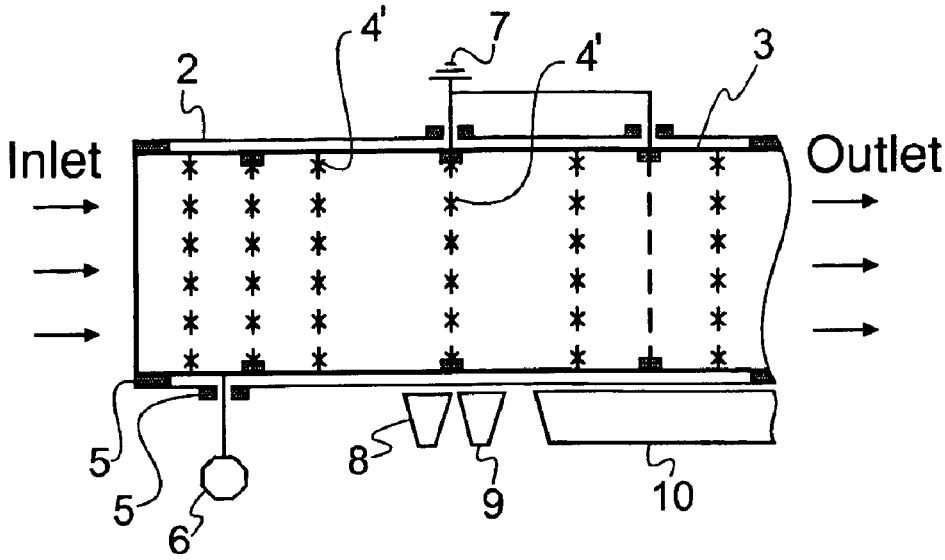

FIG. 7 is a graph of particle diameter versus number of particles and shows the size and concentration of sub-micron particles originating from low-carbon flyash at the inlet and outlet of a sieving electrostatic precipitator FIG. 8 is a graph of particle diameter versus number of particles and shows the size and concentration of sub-micron particles originating from high-carbon flyash at the inlet and outlet of a sieving electrostatic precipitator FIG. 9 is a schematic illustrating an alternative embodiment of the present invention suitable for flyash beneficiation of carbon.

FIG. 10 is an illustration of Table 1.

FIG. 11 is an illustration of Table 2.

FIG. 12 is an illustration of Table 3.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

(h) DETAILED DESCRIPTION OF THE INVENTION

Figure 1:
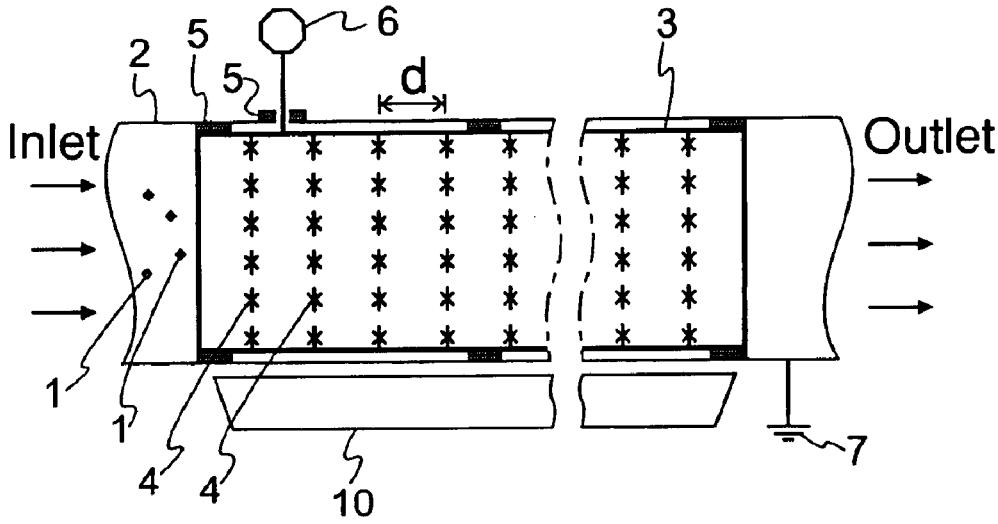

FIG. 1 shows the main section of the preferred precipitator that is especially suitable for concurrent and efficient collection of both large and fine particulate 1. The preferred precipitator is suitable for use in any environment in which particles are to be collected, agglomerated or both. The precipitator does not have to be preceded by a charging apparatus to charge or collect the particles, nor does it have to be followed downstream by any collection device. The precipitator of the present invention collects sufficient particulate that it can be used as a stand-alone unit. The precipitator has a plurality of closely packed planar conductive screens 4', set apart at distance d which is preferably a few millimeters. The screens 4' can be made from any conductive, non-corrosive and durable material, can have various opening shapes, and must be able to produce corona at sufficiently high voltages. Hence, smooth perforated plates and other similar smooth substrates cannot be used. The preferred screens are woven stainless steel wire with rectangular openings of a few millimeters or less, but the screens or meshes of the present invention can be woven or non-woven, membranes or any suitable structure. Individual screen openings typically range from 0.5 to 1.5 mm, with wire diameters of a few hundred microns. These dimensions may vary, of course, depending on applications. It is contemplated that for particles ranging in size from 0.0 to 200 microns, the size of the openings in the screens will not exceed a few millimeters.

The screens 4 are mounted in the electrically conductive screen housing 3, which has an open bottom above the hopper 10. The distance between the screens 4 is preferably between one millimeter and 10 millimeters, and more preferably three to five millimeters. The screen housing 3 is connected to the high voltage source 6 and is mounted in the grounded ductwork 2, from which it is insulated. In the preferred embodiment of FIG. 1, all of the screens 4 have the same polarity and the same charge, and a corona is formed on the screens 4. The particulate can only pass through screens or go into the hopper. Of course, the charge can be different along the length of the array of screens, but this is not a requirement.

Figure 2A:
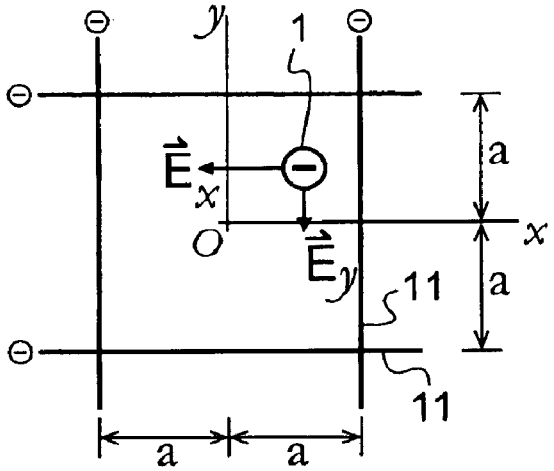
Figure 2B:
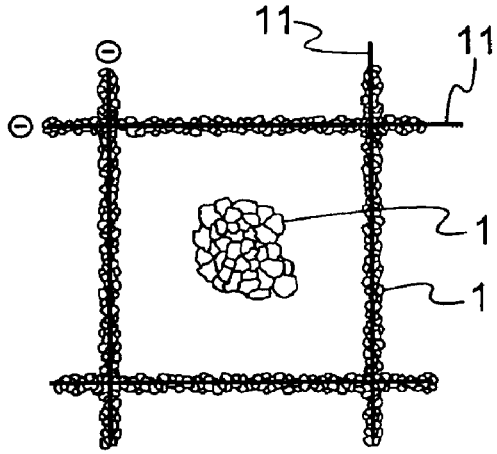

Thus, a significant percentage of the particles 1 entering the precipitator strike the first screen 4 or pass through the corona formed thereon and become charged with the same polarity as the screen 4. It is theorized that when the charged and uncharged particles continue on and flow through the openings in the next downstream screen, which has the same polarity and charge as the first screen, the electric field E produced by the similarly charged wires around the opening repels the particles to the middle of the opening as shown in FIG. 2(*a*). Together with the force exerted by corona wind which has the same direction, this force overcomes the repulsive forces between the particles causing the particles to agglomerate in the middle of the screen opening, thus increasing the size of the particles as shown in FIG. 2(*b*), and increasing their charge. Uncharged particles that do not agglomerate can be partly collected on the screens, such as in FIG. 2(*b*), and partly become charged as they pass through the second screen's opening, thereby continuing the process of agglomeration at the next downstream screen. As mentioned earlier, this process is also enhanced by corona wind produced by screen wires and emitted in all directions. The force exerted by this wind on a particle entering the screen has the same direction as the electric field E shown in FIG. 2(*a*). Those forces overcome the repelling forces that equally polarized particles act on each other. Eventually, the agglomerated particles attain a size and a charge that prevents them from passing through the opening in the next downstream screen. At this point, the particles "hover" between the screens, being pushed downstream by the oncoming gas flow but slowed down by the next screen due to electrostatic repulsion. These particles thus migrate downwardly due to random movement and the force of gravity and are collected in the hopper 10.

The number of screens 4 is selected so as to maximize the particle agglomeration, while keeping the pressure drop at a minimum. For example, in the preferred embodiment of FIG. 1, let d=0.6 cm, the screen solidity factor (the ratio of blocked area to total screen area) s=0.52, with 80 stainless steel screens measuring 10 cm by 10 cm square. The screens are made of 304 stainless steel with openings 0.991 mm across and wire diameter $d_w$=432 microns (McMaster-Car part number: 9226T732). With a flyash concentration of 5 g/m$^3$, which is intermediate of the typical value in conventional precipitators of 3 to 7 g/m$^3$, and a gas speed of u=2.0 m/s, which is much higher than in most conventional precipitators, measurements have shown that the pressure drop at room temperature was only 0.06 inches of water, and the collection efficiency was very close to 100%. The Reynolds number in this example, based on the wire diameter, is found to be $Re=ud_w/((1-s)v)=120$ at room temperature, where v is kinematic viscosity, indicating that the precipitator operates in laminar flow conditions. To some extent this can explain why the collection efficiency is much higher than in conventional precipitators operating in turbulent flow conditions. The voltage applied to the screens 4' is typically 40 kV to 50 kV or more, and must be above the corona onset threshold.

With the above configuration and parameters, all large and small particles passing through the large number of highly charged screens with small openings are unlikely to escape charging. All charged particles have the same charge of the same polarity as the screens 4. Due to the strong electric field E, the particles flowing through each opening are repulsed away from the screen wires and pushed toward the middle of the screen openings, where they concentrate and agglomerate in a comparatively small area with respect to the total area of the opening. A very small amount of particles is collected on wire screens as well, as shown in FIG. 2(*b*). Because the wires are only minimally coated by an insulating particulate layer, corona production is still significant, and this results in increased particulate charging efficiencies over the prior art. This also results in a requirement for less frequent cleaning of the screens, about every 15 to 30 minutes or more.

The particles are repulsed by the screen wires towards the openings' centers not only by the strong electric field intensity E but also by a very strong corona wind generated by the wires in all directions. When the particle is passing through the screen the component of the force exerted by corona wind that, at that instant, coincides with the plane of the screen becomes collinear with the electric field E shown in FIG. 2. Since the screens are kept very close to each other, preferably within a few millimeters, the corona wind generated by a given screen also helps to keep the screens clean on the upstream and downstream sides. Lowke and Morrow have measured the corona wind to have speed of 2.5 m/s at a distance only 1.0 cm away from a weighted wire that is used in older-generation conventional precipitators and is exposed to 50 kV (see J. J. Lowke and R. Morrow: "The Role of Corona Wind in Electrostatic Precipitation", 5$^{th}$ International Symposium on Electrostatic Precipitation, Kyongju, Korea, 1998). It is therefore to be expected that the corona wind speed would be very high within the screen openings of a size close to 1.0 mm, and this corona wind aids in particle agglomeration as the particles flow through the openings. This also indicates that the applied voltage, which determines the strength of the corona wind, needs to be optimized versus the screen openings and the distance between the screens.

Since all screens 4 have the same polarity, there is virtually no limit to the voltage that could be applied to the screens, and the distance between the screens can be kept at minimum without any sparkover. The distance between the screens 4' can be greater than 10 mm, but with too large a distance the particles can lose their charge between the screens 4. In addition, strong corona winds induce mutual cleaning of neighboring screens. Therefore, it is preferred to space the screens 4 only a few millimeters from one another, but this spacing needs to be optimized versus the applied voltage and the size of screen openings.

The power consumption in the preferred embodiment is also very low. At a charge of 50 kV on all 80 screens as described above, the current is only about 0.13 mA. At 30 kV the current is only about 0.1 mA.

The preferred embodiment results in good particle charging, increased agglomeration, increased collection efficiencies, and a drastic reduction of precipitator size over the prior art. With a distance d=2.5 to 5 mm, one hundred screens can be placed in a precipitator's main section and occupy less than 0.5 m of its length. Because most of the particulate is collected by the first several screens, typically the first five, the distance between the upstream several screens can be enlarged to allow freer flow of particulates downwardly through the gap between the screens into the hopper below. Because the remaining downstream screens collect much less of the total particles collected than the upstream screens, the downstream screens can be more closely packed if necessary or desirable. In one example, the upstream several screens are spaced apart about 4.0 to 6.0 mm and the more downstream screens are spaced apart about 2.0 to 4.0 mm.

The collection efficiency of the invention does not depend significantly on the gas flow speed through the screens. This means that the precipitator's cross sectional area can be reduced considerably and the gas speed increased 2 to 3 times that of conventional precipitators, for example up to 3 to 4 meters per second, without substantially affecting efficiency more than about 1%. Although this requires the addition of new screens to increase the collection efficiency, with a small screen spacing the total volume of the precipitator main section will therefore have two orders of magnitude smaller volume than in conventional precipitators, while the pressure drop will still be minimal.

The screens can also have different opening sizes and shapes at different positions along the gas flow stream. For example, the most upstream several screens can have larger openings so that when they become coated with particles there is not a significant rise in pressure drop across the precipitator. Thus, the more downstream screens can have smaller openings as the loading level decreases downstream to increase particle charging and agglomeration. Based on numerous experiments, this variation is noticeable but not critical. The most important factor in collection is to keep the screens clean. Clean screens with larger openings have higher dust collection efficiencies than dirty screens with small openings. The best choice for the screens/wires is the one that maximizes the corona production. Of equal importance is to keep the screens at a very small distance and to apply a high voltage, commensurate with the screen opening size and distance between the screens, to enhance a "self cleaning" of the screens by corona wind.

Cleaning the small precipitator of the present invention is easier than cleaning conventional precipitators, because the screens weigh a small portion of stiffened plates used in conventional precipitators. Thus, it is much easier to shake or move the screens, which means that more mechanisms or devices can be utilized for cleaning the screens. Examples of such devices include sonic horns, compressed air, vibrating/shaking mechanisms, and other conventional ESP cleaning mechanisms as will become apparent to the person of ordinary skill. Using such particle-removal devices will cause the particulate matter on the screens to be moved downwardly to the hopper or hoppers, or will otherwise collect the particles for removal.

A number of experiments have been conducted, and a measurement of particle collection efficiency has been obtained. The experiments were performed at room temperature and with low-carbon flyash originating from precipitators of the Gavin Power Plant, Chesire, Ohio. The flyash was delivered to the experimental equipment by a Schenk Process GMBH screw feeder, Model MOD102M and mixed with air before the precipitator inlet. The air was delivered by a variable speed blower. The flyash concentration was about 4 g/m$^3$ and 8 g/m$^3$. There were 80 screens with the properties described above. The distance between the screens was 3.0 mm. The voltage applied was 50 kV and the current was typically about 0.13 mA. The 10 cm by 10 cm square screens were installed in the frontal part of a horizontal Plexiglas duct with a total length of about 1.2 meters. The precipitator outlet was connected to a 15-meter tall chimney with a diameter of about 40 cm, via a fan with a capacity of about 12,000 ft$^3$/minute and which provided an additional draft. The gas velocity in the precipitator duct was 2.0 m/s. The pressure drop across the screens was measured with a Dwyer Instruments gauge with a range of 0.0 to 1.0 inches $H_2O$, while the gas flow speed was measured by Omega Engineering's hotwire anemometer, Model FNMA906V.

Before each new experiment the flyash remaining from the previous experiment on the screens and the duct was thoroughly removed with the blower. The collection lasted 10 minutes and the amount of flyash delivered was about 48 grams for the concentration of 4 g/m$^3$ and 96 grams for the concentration of 8 g/m$^3$ with a margin of error of 1.5%. In all experiments the amount of flyash remaining on the screens was hardly noticeable and was about 2–4% in total (on all screens together). Most of that flyash, however, remained on the few upstream screens, which indicates that those screens could have somewhat larger openings than the downstream screens to maintain the efficiency even during heavier loading of the upstream screens.

The pressure drop across the screens, without the flyash passing through, was 0.04 inches of $H_2O$ when the screens were not charged, and 0.06 when the screens were charged. The pressure drop with charged screens and in the presence of flyash was also about 0.06.

The collection efficiency was measured as the ratio between the combined weights of the flyash collected in the hopper and the flyash remaining on the screens, and the weight of the flyash delivered to the first screen. Starting from 40 screens and low collection efficiency, with dust concentrations of 4 g/m$^3$, the number of screens was gradually increased up to 80, at which configuration the collection efficiency was believed to be very close to 100% taking into consideration all possible experimental errors. Then, with 80 screens, the flyash concentration was increased to 8 g/m$^3$. The collection efficiency was found to decrease only about 1%.

Figure 3:
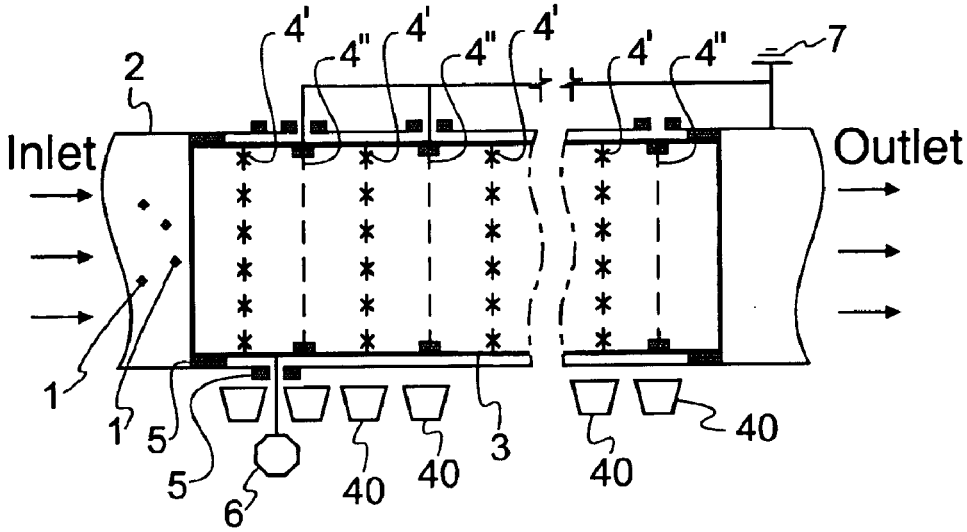

An alternative embodiment of the present invention is shown in FIG. 3. In the embodiment of FIG. 3, the screens have alternating polarities. Thus, the high voltage corona-producing discharge screen electrodes 4' alternate with grounded screens 4". Both screens 4' and 4" preferably have the same material and mechanical properties as the screens of the embodiment shown and described in FIG. 1, although this is not required. In the FIG. 3 embodiment, the distance between the screens depends on the voltage applied and must be kept above a minimal value in order to avoid sparkover. If the distance between the screens is increased, higher voltage can be applied but the particles lose their charge while traveling between the screens. Typical distances are one to three inches for screens charged at about 10 kV to 40 kV. Corona is formed on the high voltage discharge screen electrodes 4' but not on grounded screens 4".

The increased spacing between the screens of the FIG. 3 embodiment increases the precipitator's overall length, and results in less efficient particle charging than in the FIG. 1 embodiment. Also, the power consumption is higher than in the FIG. 1 embodiment. At 30 kV and with only 15 charged screens the current in the FIG. 3 embodiment was measured to be 0.3 mA.

Figure 4A:
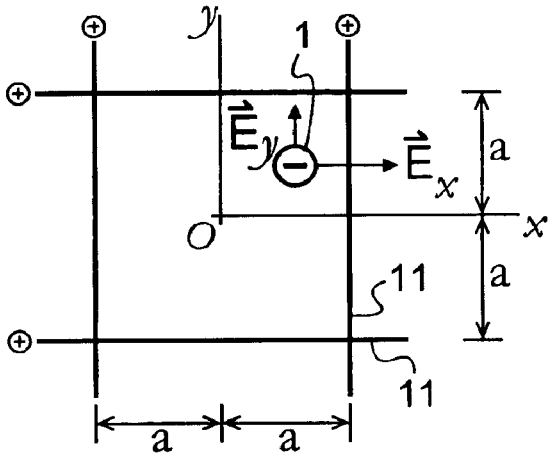
Figure 4B:
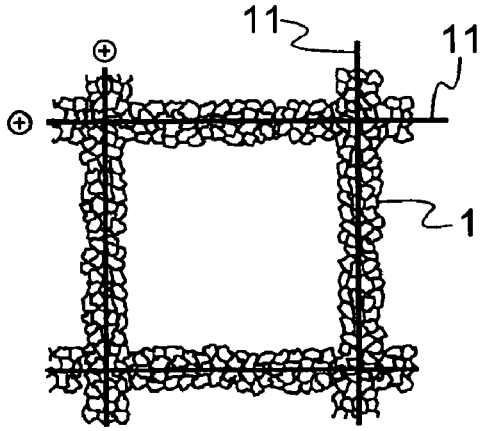

The particle agglomeration in the alternative embodiment takes place on the screen's wires, as illustrated in FIGS. 4(*a*) and 4(*b*), rather than mostly inside the screen openings as in the FIG. 2 of the first embodiment. At the discharge electrode screen opening the electric field E has the opposite direction than the force exerted by corona wind, which contributes to somewhat increased coating of the wires and less efficient particle charging.

However, despite its apparent disadvantages, the alternative embodiment is suitable for particulate classification and beneficiation. For example, it is well known that fly ash recovered from different fields of conventional precipitators differ in size, chemistry, and mineralogy, and that such flyash is considerably different in size and composition from air-classified or conventionally sieved ash (i.e. without electrostatic precipitation). In addition to aerodynamic properties, other factors such as the presence of trace elements on the particulate surface and the resulting charge prevail. Electrostatic sieving precipitation and beneficiation could therefore be more diverse than simple sieving and could offer more options and potential benefits. Thus, in the FIG. 3 embodiment, there are multiple hoppers 40 beneath the screens so that the ash precipitated from the gas is automatically separated into different containers mounted below the screens and having dividers that can separate the ash before and after each screen (or group of screens), such as bins 8 and 9 shown in FIG. 9 below. This permits the separated ash in the separated containers to be used for different purposes. The hoppers 40 in FIG. 3 are drawn exaggerated in size and number for illustrative purposes only. The hoppers 40 are not necessarily positioned in the desired position. However, the number, size and position of the hoppers 40 will become apparent to a person of ordinary skill.

While passing through fine screens, such as the ones that are used in the present invention, particles virtually cannot escape charging. Very intense friction due to mutual collision of particles and their collision with screens also results in triboelectrostatic charging. Consequently, various particles are charged with different intensities. This, in turn, presents a good opportunity for better charged particles to be captured by the screens, or to pass and fall into hoppers below the screens, if they are weakly charged. Better charged particles (e.g. carbon) will remain on the screens longer before sliding down into the hoppers, while the minerals pass through and are stopped by downstream screens. Hence, the flyash components captured before and after a collection screen (i.e., at different points along the precipitator stream) differ in contents. In addition, captured particles differ in size, because larger particles are captured by upstream screens and in upstream hoppers while the downstream screens and hoppers contain finer particulate. We have found that this phenomenon is strikingly more pronounced in the FIG. 3 embodiment than in the embodiment in which all screens have the same polarity.

Experimental results have confirmed that electrostatic sieving can be used for particulate classification in dry conditions. The experiments were conducted in the Ohio University ESP Laboratory using a bench-scale precipitator similar to that shown in FIG. 3, having 15 pairs of 10 cm by 10 cm square discharge and collection screens with 0.5 mm openings, made from 304 stainless steel. The field voltage was 25 to 35 kV, and the current was about 0.3 mA. The gas stream velocity in the precipitator was about 2.7 m/s. The dust concentration varied from 10 to 20 g/m$^3$, which is several times greater than in conventional precipitators. The pressure drop across all screens was about 0.3 inches of $H_2O$. The distance between the screens was 0.1.5 inches. The experiments were conducted with flyash originating from electrostatic precipitators in two power plants: low-carbon (2.4%) flyash from the EPA Gavin Power Plant, Chesire, Ohio and high-carbon (16%) flyash from the EPA Glen Lyn Power Plant, VA. A set of identical, but uncharged, screens was installed in a parallel duct to permit a comparison to be made between the electrostatic sieving and the uncharged sieving.

Ash fractions collected in separate bins below the first and the tenth grounded (collection) screens of the FIG. 3 embodiment were analyzed. Particle numbering and size characterizations were performed by the Beckman Coulter Particle Characterization Lab, Miami, Fla. Each sample had about $10^8$ particles. The analysis showed that the mean size of particles beneath the first grounded screen in electrostatic sieving was only 2.84 microns while the corresponding screen in conventional sieving captured particles with a mean size of 4.56 microns. Similar results were found at other downstream locations. This result indicates that a large and important difference exists in the FIG. 3 embodiment, which can be advantageously used for the purpose of separation and beneficiation of flyash components.

Figure 5:
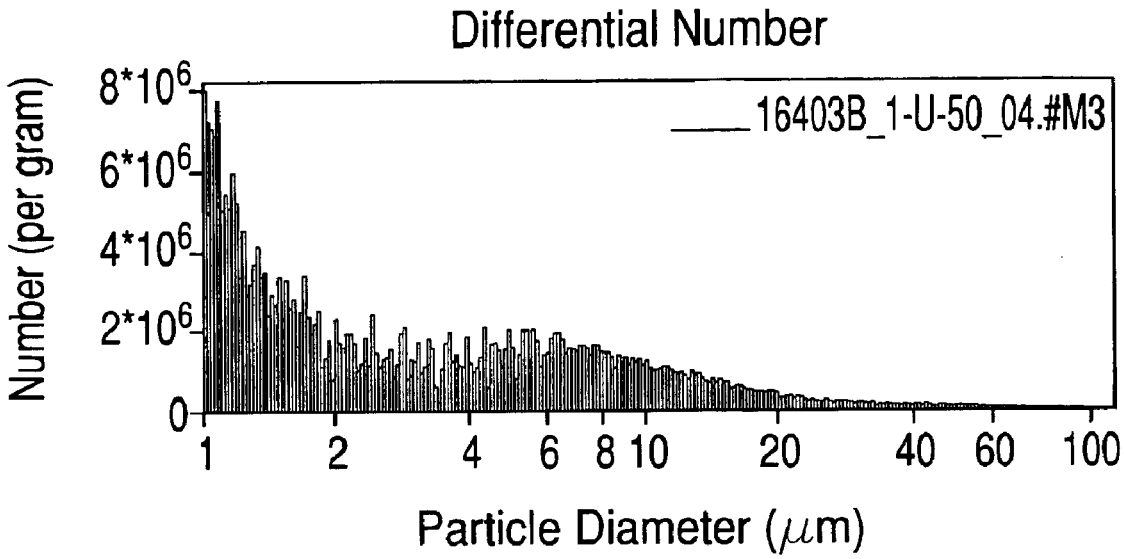
FIG. 5 is a graph of particle diameter versus number of particles and shows the size and concentration of particles captured by the first screen via conventional sieving, i.e. without charging the screens.
Figure 6:
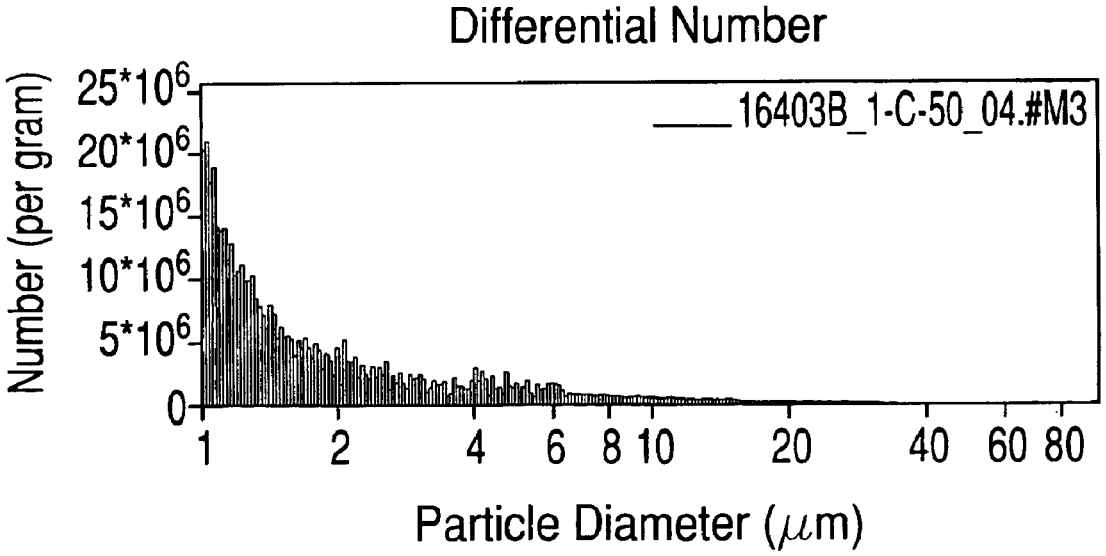
FIG. 6 is a graph of particle diameter versus number of particles and shows the size and concentration of particles captured by the first screen via electrostatic sieving.

The same analysis showed that the very first screen of the FIG. 3 electrostatic sieving precipitator collected about three times more 1-micron sized particles then the same screen would collect in conventional sieving, as reflected in the data shown in FIG. 5 and FIG. 6. The relative drop in size at the tenth screen was found to be even more pronounced at about ten times, $30\times10^6$ vs. $3\times10^6$.

The following experiments were also conducted utilizing the alternative embodiment shown in FIG. 3, at room temperature with only seven collection screens. The flyash loading into the precipitator was about twice as high as in typical precipitators used in power plants. FIGS. 7 and 8 show the particle size and concentration at the precipitator inlet and outlet for the two ashes specified above (low- and high-carbon fly ashes), measured with the TSI Scanning Mobility Particle Sizer (SMPS) Model 3936L22. As can be seen, collection efficiency of sub-micron particles is remarkable. A high concentration of very small particles in FIG. 7 is due to the ambient air in the lab, which was cut off before the measurements of FIG. 8 were taken. It is noticeable that the capture of the high carbon flyash somehow enhances the capture of even those extremely small particles.

It has also been observed that the flyash components collected in the bin in front of the very first grounded (collection) screen were much darker in color than the flyash constituents collected in the bin immediately after the first screen. This difference was not observed in the bins beneath discharge electrodes 4' of the embodiment of FIG. 1 and was much less pronounced beneath the first screen of the uncharged sieving duct (i.e. in the absence of charging of flyash). Hence, the embodiment similar to that in FIG. 9 with one or more charging screens in front of a grounded screen can be used for beneficiation of unburned carbon, provided that two different hoppers are used: an upstream hopper 8 (before the collection screen) and a downstream hopper 9 (behind the screen).

As shown in FIG. 10, Table 1 presents the results of a typical carbon content analysis of flyash components collected in the front (F) and back (B) hoppers by the first and the fifth grounded screens, denoted by 1 and 5, as well as of the original flyash sent into duct (FA), in both electrostatic (E) and conventional sieving (C). The low-carbon flyash originates from the hoppers of electrostatic precipitators of the Gavin Power Plant, Chesire, Ohio. The analysis was done by the LECO Corporation, St. Joseph, Mich.

The results indicate that most of the carbon is collected in the frontal hopper of the first grounded screen, i.e. by the hopper 8 in FIG. 9, and that 15% of the flyash components collected there is unburned carbon. Hopper 9, however, collected only 1.46%. Carbon content in other downstream hoppers was also minimal. Notice that in conventional sieving the first screen would collect only 9.69%. This means that in both conventional and electrostatic sieving the first screen collects carbon because the unburned carbon particles are large in size. However, a large difference between the two values indicates that charging the particles greatly enhances carbon beneficiation.

Based on the measured total amount of flyash collected in hopper 8 by the first screen alone (about 5%), and the known percentage of the carbon captured there (15%), we have calculated that if this carbon is re-burned, the total savings in midsize power plants is still on the order of hundreds of thousands of dollars per year.

The analysis also indicated that the bin 9 of FIG. 9, located after the first grounded screen of the sieving electrostatic precipitator, collected many times more Nitrogen than any other bin (see Table 2 in FIG. 11). It was calculated that 11% of the total Nitrogen content in flyash was captured in front of the first collection screen (bin 8) and 4% after it (bin 9), i.e. a total of 15%.

It was thought that the chemical analyses of the flyash collected by the sieving precipitator could give more interesting information about flyash beneficiation. The samples analyzed by the Oxford Instruments Inc. using the Multi-Dispersive X-ray Fluorescence spectrometer have indeed confirmed the expectation. In these analyses it was found that the flyash has been beneficiated to a very large extent for sulfur. Typical results from one of several tests conducted on the above mentioned low- and high-carbon fly ashes is shown in Table 3 (FIG. 12). The results indicate that the bin 8 in front of the first collection screen, FIG. 9, collects a very large amount of sulfur and that other bins collect much smaller amounts. However, since the bin 9 behind the first screen typically collects three times more than bin 8, we have found that the two bins 8 and 9 combined collect as much as 40% of the total sulfur in the flyash delivered to the sieving electrostatic precipitator. All the above results indicate that the properties of the precipitated flyash components if collected in different bins (or groups of bins) can have very different properties and could be potentially exploited for various purposes.

It will become apparent to persons of ordinary skill that the above-described embodiments of the invention can be combined, so that there is a precipitator with a field or array of screens all of the same charge, followed by a field or array of screens of alternating charge. Alternatively, these could be reversed or made into various combinations and mixtures of screen charges, spacing and collector bin placement. All embodiments of the invention can operate at very high temperatures if the screens are made from adequate material. All embodiments can also be modified to operate in wet conditions as wet precipitators if properly washed with water or other appropriate liquid delivered from troughs or other applicators mounted on top of screens the way it is done in conventional wet precipitators, such as are disclosed in U.S. Pat. No. 6,231,643 to Pasic et al., which is incorporated by reference.

While certain preferred embodiments of the present invention have been disclosed in detail, it is to be understood that various modifications may be adopted without departing from the spirit of the invention or scope of the following claims.

What is claimed is:

1. An electrostatic particulate collection apparatus mounted in a fluid stream containing particulate matter, the apparatus comprising:

a) a first substantially planar screen mounted in the fluid stream transverse to a fluid stream flow direction, said first screen having an electrical charge sufficient to create a corona and a plurality of openings smaller than about three millimeters;

b) a second substantially planar screen mounted in the fluid stream transverse to the fluid stream flow direction and spaced from the first screen less than about 10 millimeters, said second screen having a plurality of openings smaller than about three millimeters and an electrical charge of the same polarity as the first screen's electrical charge and sufficient to create a corona; and c) a collector below at least one of the screens for receiving particulate.

2. The electrostatic particulate collection apparatus in accordance with claim 1, further comprising an array of substantially planar screens mounted in the fluid stream transverse to the fluid stream flow direction, spaced less than about 10 millimeters from said second screen, and each of the screens in said array having a plurality of openings smaller than about three millimeters and an electrical charge of the same polarity as the first screen's electrical charge and sufficient to create a corona.

3. The electrostatic particulate collection apparatus in accordance with claim 2, wherein the openings in the first and second screens are about one millimeter.

4. The electrostatic particulate collection apparatus in accordance with claim 3, wherein the distance between the first and second screens is less than about five millimeters.

5. The electrostatic particulate collection apparatus in accordance with claim 4, wherein the collector has an electrical charge of opposite polarity to the first and second screens.

6. The electrostatic particulate collection apparatus in accordance with claim 5, wherein the fluid stream has a fluid velocity through the screens of less than 10 meters per second.

7. The electrostatic particulate collection apparatus in accordance with claim 2, wherein the screens are substantially perpendicular to the fluid stream flow direction and substantially parallel to one another.

8. The electrostatic particulate collection apparatus in accordance with claim 2, wherein the distance between the first and second screens is greater than the distance between at least two downstream screens in the array.

9. The electrostatic particulate collection apparatus in accordance with claim 2, wherein the openings in the first and second screens are larger than the openings in at least one downstream screen in the array.

10. The electrostatic particulate collection apparatus in accordance with claim 8, wherein the openings in the first and second screens are larger than the openings in at least one downstream screen in the array.

11. The electrostatic particulate collection apparatus in accordance with claim 10, wherein the screens are woven wires.

12. The electrostatic particulate collection apparatus in accordance with claim 11, wherein the wires are stainless steel.

13. An electrostatic particulate collection apparatus mounted in a fluid stream containing particulate matter, the apparatus comprising:

a) a first substantially planar screen mounted in the fluid stream transverse to a fluid stream flow direction, said first screen having an electrical charge sufficient to create a corona and a plurality of openings smaller than about three millimeters;

b) a second substantially planar screen mounted in the fluid stream transverse to the fluid stream flow direction and spaced from the first screen at least about one-half of an inch, said second screen having a plurality of openings smaller than about three millimeters and an electrical charge of different polarity from the first screen; and c) a first collector below the first screen and a second collector below the second screen for receiving particulate from the respective screens.

14. The electrostatic particulate collection apparatus in accordance with claim 13, further comprising an array of substantially planar screens mounted in the fluid stream transverse to the fluid stream flow direction, spaced at least about one inch from said second screen, and each of the screens in said array having a plurality of openings smaller than about three millimeters and an electrical charge of the same polarity as one of the screens' electrical charges.

15. The electrostatic particulate collection apparatus in accordance with claim 14, further comprising an array of collectors mounted below the array of screens for receiving particulate from respective screens in the array and keeping separate the particulate from some of the screens in the array from the particulate from others of the screens in the array.

16. The electrostatic particulate collection apparatus in accordance with claim 15, wherein the openings in the first and second screens are about one millimeter.

17. The electrostatic particulate collection apparatus in accordance with claim 16, wherein the first collector has an electrical charge of opposite polarity to the first screen and the second collector has an electrical charge of opposite polarity to the second screen.

18. The electrostatic particulate collection apparatus in accordance with claim 17, wherein the fluid stream has a fluid velocity through the screens of less than 10 meters per second.

19. The electrostatic particulate collection apparatus in accordance with claim 15, wherein the screens are substantially perpendicular to the fluid stream flow direction.

20. The electrostatic particulate collection apparatus in accordance with claim 15, wherein the distance between the first and second screens is greater than the distance between at least two downstream screens in the array.

21. The electrostatic particulate collection apparatus in accordance with claim 15, wherein the openings in the first and second screens are larger than the openings in at least one downstream screen in the array.

22. The electrostatic particulate collection apparatus in accordance with claim 20, wherein the openings in the first and second screens are larger than the openings in at least one downstream screen in the array.

23. The electrostatic particulate collection apparatus in accordance with claim 22, wherein the screens are woven of wire.

24. The electrostatic particulate collection apparatus in accordance with claim 23, wherein the wire is stainless steel.

* * * * *